US005244188A

United States Patent [19]

Kämmerling et al.

[11] Patent Number: 5,244,188

[45] Date of Patent: Sep. 14, 1993

[54] LOCKING DEVICE FOR THE OVEREXTENSIONING OF A PIPELINE COMPENSATOR

[75] Inventors: Bruno Kämmerling, Dinslaken; Rainer Schmidt, Oberhausen, both of Fed. Rep. of Germany

[73] Assignees: Man Gutehoffnungshütte Aktiengesellschaft, Oberhausen; Steinfurter Eisenwerk GmbH, Steinfurt, both of Fed. Rep. of Germany

[21] Appl. No.: 861,658

[22] Filed: Apr. 1, 1992

[30] Foreign Application Priority Data

Apr. 2, 1991 [DE] Fed. Rep. of Germany ..... 4110628

[51] Int. Cl.[5] ..... C21B 7/16

[52] U.S. Cl. ..... 266/270; 266/265

[58] Field of Search ..... 266/174, 265, 270

[56] References Cited

U.S. PATENT DOCUMENTS

| | | | |
|---|---|---|---|
| 4,027,605 | 6/1977 | Legille | 266/270 |
| 4,465,265 | 8/1984 | Kryczun et al. | 266/270 |
| 4,865,298 | 9/1989 | Jordan | 266/270 |

*Primary Examiner*—Scott Kastler

*Attorney, Agent, or Firm*—McGlew and Tuttle

[57] ABSTRACT

To absorb thermal expansions and relative movements, as well as to transmit torques, compensators, which are provided with an overtensioning device, are installed between the tuyere connections of a blast furnace and the hot-blast circulating duct. During the regular replacement of expendable parts of the tuyere connection, at least the elbow (4) must be removed as well, so that the intermediate pipe section (5) lined with refractory material will hang freely on the compensator (1). To achieve short replacement times, the compensator (1) is fixed according to the present invention by means of a locking device, and again disengaged on completion of the maintenance work. The locking device includes two flat bars (6), which are rigidly connected at the upper compensator flange (7). Threaded bolts (9), which extend into the flat bars (6) through openings (12), are fastened at the lower compensator flange (8). To fix the lower compensator flange (8), nuts (10) and lock nuts (11) are screwed onto the threaded rod (9) and pressed against the flat bars (6) in a frictionally engaged manner by tightening the lock nuts (11). As an alternative, locking of the compensator (1) may also be performed hydraulically. In this case, a mounting pressure cylinder is inserted into an opening of the compensator flange (8) and is pressed against the respective flat bar (6) by means of a hydraulic pump.

9 Claims, 2 Drawing Sheets

LOCKING DEVICE FOR THE OVEREXTENSIONING OF A PIPELINE COMPENSATOR

FIELD OF THE INVENTION

The present invention pertains to a locking device for the overtensioning of a pipeline compensator, wherein two straps, which transmit the shearing forces via a crossbolt and a sliding block to a strap fastened on the opposite side, are fastened on one side of the overtensioning of the compensator.

BACKGROUND OF THE INVENTION

Such compensator overtensioning devices are intended to compensate the movements of hot pipelines of shaft furnaces, especially in blast furnaces, e.g., in blast-furnace gas pipeline systems. Such compensators with overtensioning devices according to German Publication DE 36,41,138 C1 can also be used in hot-blast circulating duct systems, from which tuyere connections lead to the individual tuyeres, from which hot blast is blown into the furnace body, because expansions or thermal stresses may occur between the furnace body and the hot-blast circulating duct as a consequence of the considerable temperature differences occurring there. The prior-art compensators with corresponding overtensioning devices are to permit angular movements and axial displacements of the tuyere connections.

Expendable parts, such as tuyeres, nozzle tips, as well as elbows and intermediate pipes, must be dismounted and replaced at regular intervals during the blast furnace operation.

SUMMARY AND OBJECTS OF THE INVENTION

It is a primary object of the present invention to reach the shortest possible downtimes for nozzle replacement and to fix the compensator in its position during the replacement of the individual parts of the tuyere connection, so that the weight of the parts still hanging on the compensator—intermediate pipe or intermediate pipe with tuyere connection elbow—can be absorbed.

According to the invention, a compensator is provided to absorb thermal expansion and relative movement as well as to transmit torque and is installed between a tuyere connection of a blast furnace and the hot-blast circulating duct. The compensator is provided with a overtensioning device.

The overtensioning device of the compensator includes two straps, a cross bolt and a sliding block. The sliding block is fastened to another strap on an opposite side of the two straps. The overtensioning device is fastened to one side of the compensator. Another overtensioning device can be fastened to another side of the compensator. The overtensioning device transmits shearing forces from the two straps to the opposite another strap, but allows angular movements and axial displacements of the tuyere connections.

The invention allows for quick replacements during the regular replacement of expendable parts of the tuyere connection wherein at least the elbow must be removed so that the intermediate pipe section lined with refractory material will hang freely on the compensator. The invention provides a locking means for fixing the compensator during the replacement time and for again unlocking or disengaging the compensator upon completion of the maintenance work. The invention provides a locking means comprising two flat bars which are rigidly connected to an upper flange of the compensator. Threaded bolts are fastened to the lower compensator flange and extend into the flat bars through openings. Nuts and lock nuts are screwed onto the threaded rod and pressed against the flat bars in a frictionally engaged manner by tightening the lock nuts to fix the lower compensator flange relative to the flat bars. As an alternative, the locking means may be formed of a hydraulic unit wherein a mounting pressure cylinder is inserted into an opening of the compensator flange and is pressed against the respective flat bar by means of a hydraulic pump in order to fix the flange relative to the flat bar in a frictionally engaged manner.

In the locking means according to the present invention the two flat bars, which have an opening on the loose side, are rigidly connected to a compensator flange offset by 90° relative to the overtensioning device of the compensator.

For applications in which the compensator has to absorb only low weights during locking, it is sufficient to provide only one flat bar.

Threaded bolts, which are inserted into openings on the flat bars, are fastened to the other flange of the compensator. The openings on the flat bars must be large enough not to hinder relative movements between the flat bars and the threaded rods.

At the time of the intended replacement of parts of the tuyere connection or even of the entire tuyere connection, the locking is actuated by placing nuts on the threaded bolt, bringing them into contact with the flat bars, and fixing the compensator and the compensator overtensioning device between two flanges by tightening by means of lock nuts.

The forces and torques occurring on the lower compensator flange during the replacement of parts of the tuyere connection or of the entire tuyere connection are transmitted at this point in time via the compensator overtensioning and locking device.

On completion of the repair work and prior to putting the tuyere connection into operation, the locking device is disengaged by removing the two nuts from the threaded rods and the locking device is put out of operation.

Instead of the above-described fixation of the flat bars, the flat bars may also be locked with the compensator flange by means of a portable mounting pressure cylinder.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 2:
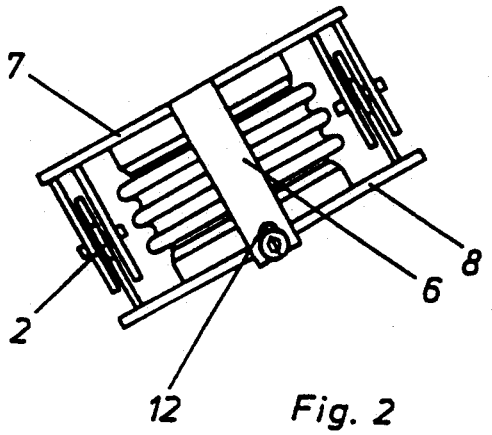
FIG. 2 is a schematic side view of the compensator.
Figure 1:
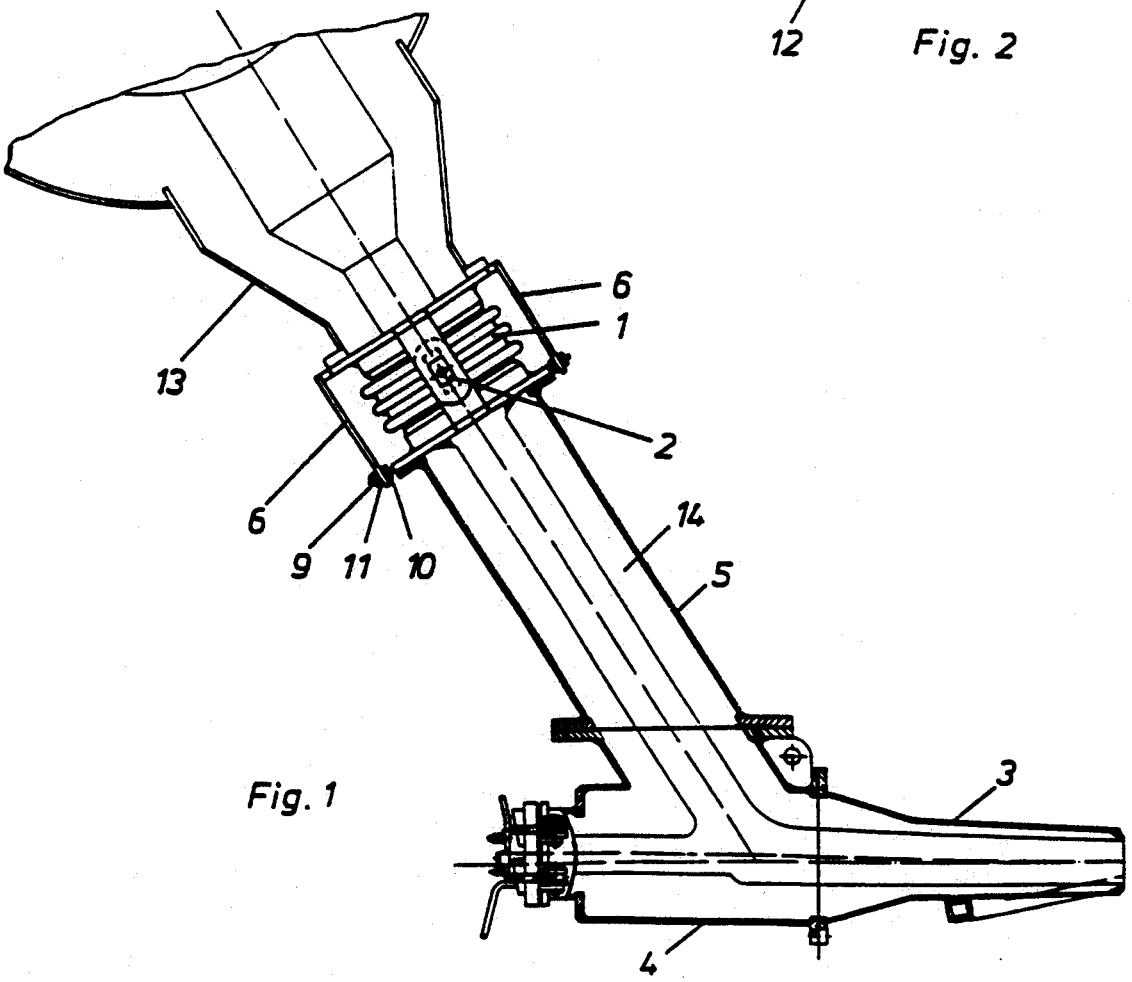
FIG. 1 is a schematic sectional view of a tuyere connection with the compensator and the locking device according to the present invention in cooperation with the compensator overtensioning device.

FIGS. 1 and 2 show the tuyere connection of a blast furnace, which is equipped with a multiwalled compensator 1 to absorb thermal expansions and relative movements between the blast furnace and the connection piece of the hot-blast circulating duct 13. To transmit shearing forces, which consist, to a great extent, of the internal pressure and the weight of the nozzle tip 3, the elbow 4, the intermediate pipe section 5, and of the refractory lining 14, the compensator 1 is provided with a compensator overtensioning device 2, which prevents movements lateral to the plane of the tuyere connection, but permits all other movements.

The expendable parts, e.g., the nozzle tip 3, must be replaced at regular intervals during the blast furnace operation. During this replacement, at least the elbow 4 also has to be removed for this replacement, and this causes the intermediate pipe section 5 to hang freely on the compensator 1.

To achieve short replacement times, the compensator 1 must be fixed in its position during the replacement of the nozzle tip 3, and the locking device must carry the weight of the intermediate pipe 5, including the refractory lining 14. The locking device consists of two flat bars 6, which are rigidly connected to the upper compensator flange 7, offset by 90° in relation to the overtensioning device 2.

Fixing means is provided including threaded bolts 9, which extend into the flat bars 6 through an opening 12, are fastened to the lower compensator flange 8.

To fix the flange 8, the fixing means also includes nuts 10 and lock nuts 11 are screwed onto the threaded bolts 9, and the flange 8 is pressed against the flat bars 6 in a frictionally engaged manner by tightening the lock nut 11.

Figure 3:
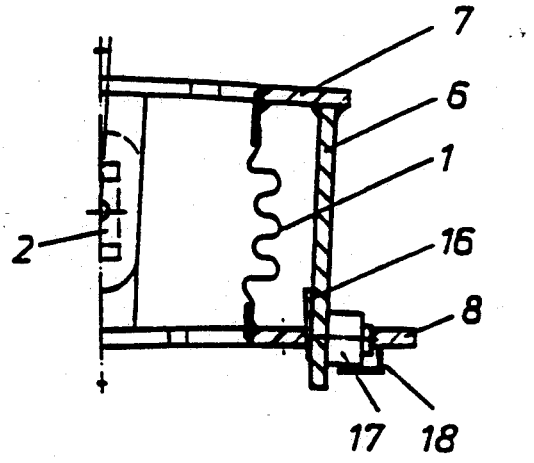
FIG. 3 is a schematic sectional view of half the locking device, which is fixed by means of a mounting pressure cylinder.
Figure 4:
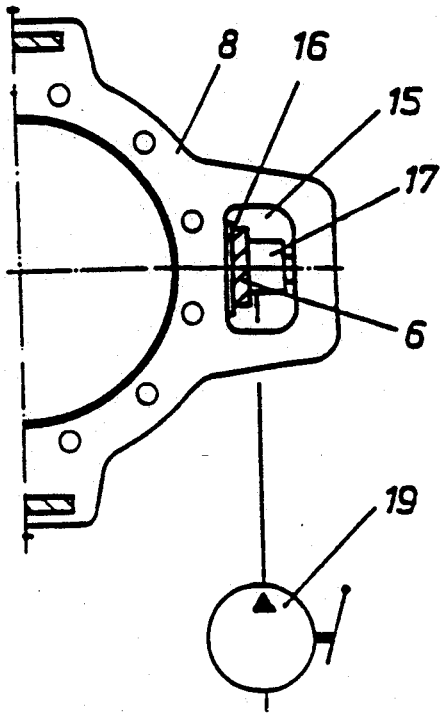
FIG. 4 is a schematic vertical sectional view of the hydraulic pressure cylinder.

FIGS. 3 and 4 show another embodiment of the locking device, which achieves the objects of the invention employing a fixing means in the form of a mounting pressure cylinder 17 instead of the above-described fixation of the flat bars 6 on the compensator flange 8.

A pressure cylinder 17 is inserted into the respective opening 15 of the compensator flange 8 and is first suspended by a bracket 18. Using a hydraulic pump 19, the hydraulic cylinder 17 is pressed against the flat bar 6 via a lining plate (or wedge) 16. As a result, the locking device is enabled to fix the compensator 1 in its position during the replacement of the above-described expendable parts 3, 4.

What is claimed is:

1. A tuyere connection comprising:

a compensator including a first flange and a second flange;

an overtensioning device fastened to said first and second flange;

locking means for holding said first flange fixed with respect to said second flange, said locking means including an opening defined by said first flange and a bar fastened to said second flange, said bar extending into said opening, said locking means also including pressure cylinder means positioned in said opening and for holding said bar in said opening in a frictionally engaged manner.

2. A connection in accordance with claim 1, wherein: said pressure cylinder means are portable.

3. A tuyere connection comprising:

a compensator including a first flange and a second flange;

an overtensioning device fastened to said first and second flange, said overtensioning device including movement means for moving said first flange axially with respect to said second flange said overtensioning device including two straps, a cross bolt, a sliding block and another strap connected to said sliding block on a side opposite to said two straps;

locking means positioned between said first and second flange and for holding said first flange fixed with respect to said second flange.

4. A locking arrangement according to claim 3, wherein said locking means comprises a lock opening provided in said bar; a threaded bolt fastened on said second flange, said threaded bolt engaging said opening of said bar; and a nut means for locking said bar to said threaded bolt.

5. A connection in accordance with claim 3, wherein: said locking means includes a bar fixedly fastened to said first flange.

6. A connection in accordance with claim 5, wherein: said bar is substantially flat.

7. A connection in accordance with claim 3, wherein: said overtensioning device and said compensator form a single joint moving said first flange with respect to said second flange.

8. A connection in accordance with claim 3, wherein: said locking means includes a locked state and an unlocked state, said locked state fixing said first flange with respect to said second flange, said first flange being moveable with respect to said second flange in said unlocked state.

9. A connection in accordance with claim 3, wherein: said first and second flanges are on substantially opposite sides of said compensator.

* * * * *